US005297492A

United States Patent [19]

Buc

[11] Patent Number: 5,297,492

[45] Date of Patent: Mar. 29, 1994

[54] ARMOR PIERCING FIN-STABILIZED DISCARDING SABOT TRACER PROJECTILE

[76] Inventor: Steven M. Buc, 53 Lake Park Ct., Germantown, Md. 20874

[21] Appl. No.: 22,894

[22] Filed: Feb. 26, 1993

[51] Int. Cl.[5] ..... F42B 14/06

[52] U.S. Cl. ..... 102/521; 102/513; 102/517; 102/526

[58] Field of Search ..... 102/513, 517, 520–527, 102/703; 244/3.24, 3.3

[56] References Cited

U.S. PATENT DOCUMENTS

| | | | |
|---|---|---|---|
| 3,111,902 | 11/1963 | Taylor | 102/94 |
| 3,262,391 | 7/1966 | Shober | 102/93 |
| 3,738,279 | 6/1973 | Eyre et al. | 102/521 |
| 3,750,578 | 8/1973 | Blajda | 102/38 |
| 4,249,466 | 2/1981 | Rossmann et al. | 102/513 |
| 4,284,008 | 8/1981 | Kirkendall et al. | 102/521 |
| 4,362,107 | 12/1982 | Romer et al. | 102/520 |
| 4,372,217 | 2/1983 | Kirkendall et al. | 102/521 |
| 4,732,086 | 3/1988 | Schiestl et al. | 102/513 |

FOREIGN PATENT DOCUMENTS 2241307 8/1991 United Kingdom ..... 102/526

*Primary Examiner*—Harold J. Tudor

[57] ABSTRACT

An improved small caliber armor piercing projectile (10) having a fin stabilized sub-caliber high density rod penetrator (11) and an adequately large tracer cavity (23). The tracer cavity does not degrade the armor penetrating capability of the projectile. The rod penetrator core is supported structurally during gun launch by a minimum weight segmented sabot (13) which engages the barrel rifling, followed by a segmented plastic obturator (15), followed by a solid plastic obturator ring (17) which provides an uninterrupted gas seal and which holds all segmented components together around the rod penetrator prior to launch. The solid obturator ring is blown apart upon muzzle exit by entrapped propellant gas pressure retained in an internal aft cavity (19). All plastic obturator components are located behind the structural sabot so that the propellant gas pressure will maintain the segmented obturator under hydrostatic compression while in the barrel to ensure projectile inbore stability. Upon muzzle exit, the segmented components freely discard from the flight projectile without introducing trajectory disturbances.

6 Claims, 4 Drawing Sheets

ARMOR PIERCING FIN-STABILIZED DISCARDING SABOT TRACER PROJECTILE

BACKGROUND OF THE INVENTION

1. Field of the Invention

The invention relates to discarding sabot projectiles, and more specifically to sub-caliber fin-stabilized armor penetrating projectiles, which contain therein rod penetrator cores, and an integral tracer of suitable pyrotechnic composition.

2. Description of the Prior Art

Heretofore, two types of armor piercing projectiles were utilized in small caliber gun systems. One of the designs was of a conventional projectile shape and was full-bore diameter, consisting of a combination of high strength steel or high density material as a penetrator swaged or inserted into a suitable jacket or sleeve material. At the projectile base was an opening for a tracer cavity of adequate depth and diameter to provide a clear visual trace of the entire projectile trajectory. This type of full-bore projectile utilized density of high strength penetrator and to some extent the jacket or sleeve material and its geometry to affect armor penetration. This type of projectile had severely limited armor penetration capability at target engagement ranges beyond several hundred meters, due to its high drag configuration.

It has been demonstrated that sub-caliber high density rod type penetrators are capable of penetrating significantly more armor than the full-bore projectiles at target ranges beyond several hundred meters. This is due to the high density rod's more efficient armor penetration geometry and the greater mass per cross sectional area of the sub-caliber rod flight projectile, which results in it losing less velocity from aerodynamic drag. To take advantage of the rod's high ballistic coefficient and to provide increased initial launch velocities, sabots were designed to encapsulate the rod penetrator during handling, storage, and gun firing, and to discard shortly after exiting the muzzle, thus allowing only the rod penetrator to continue in flight toward the target. One type of discarding sabot projectile has been demonstrated in small caliber guns to provide increased armor penetration over full-bore projectiles. This was the Armor Piercing Discarding Sabot (APDS) projectile, which utilized a spin stabilized sub-caliber penetrating core as the flight projectile. APDS projectiles using high density rod penetrators have been developed for guns from caliber 5.56 millimeter through caliber 120 millimeter. Given aerodynamic considerations, APDS projectile designs below caliber 25 millimeter did not allow the inclusion of a tracer cavity without degrading penetrator performance. The tracer cavity in these projectiles significantly reduces the available high density rod material required for armor penetration.

It has been demonstrated that armor piercing fin stabilized discarding sabot (APFSDS) projectiles penetrate more armor at greater ranges than spin stabilized APDS projectiles, due to the longer allowable penetrator lengths that can be launched and flown to the target with accuracy and stability. APFSDS projectiles utilizing high density sub-caliber rod penetrators have been developed for both rifled barrel and smooth bore guns from caliber 25 millimeter through 140 millimeter, and these designs have permitted the incorporation of an adequate tracer cavity in the rear of the flight projectile without degradation of the rod's armor penetration performance. Flechette type APFSDS projectiles utilizing high strength or high density rod penetrators have been developed for small caliber 5.56 and 7.62 millimeter rifle systems, but without allowance for a tracer cavity in the flight projectile.

Fin stabilized APFSDS projectile designs incorporating an adequate tracer cavity and developed for larger caliber systems did not efficiently scale down to small caliber projectiles due to the complexity of their sabot geometries which were optimized for the unique parameters of the larger caliber systems. Prior fin stabilized APFSDS projectile designs for smaller caliber 5.56 and 7.62 millimeter guns did not provide for a tracer cavity in the rear of the flight projectile.

Defining tracer adequacy involves consideration of complex projectile, gun, and pyrotechnic parameters. Fundamentally, however, tracer burn time, and therefore tracer cavity depth requirements are based on the time of flight of the projectile to maximum effective range. The longer the flight time is; the deeper the tracer cavity has to be. Tracer cavity diameter requirements, however, are based on the maximum effective range of the projectile trajectory. A larger diameter tracer cavity is required for projectiles which must be observed at a greater effective range. One tracer cavity tradeoff which then becomes apparent is that a slower projectile, fired to the same effective range as a faster projectile, requires a deeper tracer cavity. However, the intent of designing a faster projectile is generally to achieve greater effective ranges. Therefore, the faster projectile, although having the same time of flight, and, therefore, the same tracer cavity depth as the slower projectile, travels to a greater range in that same amount of time so that it requires a tracer cavity of larger diameter to be adequate for visual tracking.

The performance trends, therefore, in projectile design which affect tracer adequacy can be generalized to efficiently designed full-bore, APDS, and APFSDS projectiles as follows. For the same gun system, an APFSDS projectile will have a greater effective range than an APDS projectile, which will have a greater effective range than a full-bore projectile. Therefore, for that gun system, the APFSDS projectile will require a larger diameter tracer cavity than its APDS counterpart, which requires a larger diameter tracer cavity that the full-bore projectile. The time of flight of each of these projectiles to maximum effective range, however, will largely remain the same, since the faster flying projectiles are flying correspondingly farther in the same amount of time. Therefore, tracer cavity depths will largely remain equal between the full-bore, APDS, and the APFSDS projectiles.

For typical projectiles in 12.7 millimeter (0.50 inch) caliber guns, tracer cavity depths of approximately 12 millimeters are required for adequate burn times for trajectories lasting approximately two seconds. This gives a full-bore projectile trajectory trace to approximately 1000 meters, an APDS trace to 1500 meters, and an APFSDS trace to 2000 meters. In 20 millimeter caliber guns, tracer depths must be doubled to approximately 24 millimeters for adequate trajectory observation beyond 3000 meters, or 4 seconds for an APDS projectile flight time. In general, approximately 6 millimeters of tracer cavity is required for every second of flight time.

Since APFSDS projectiles will fly farther than either full-bore or APDS projectiles from the same gun, APFSDS projectiles require a larger diameter tracer cavity to maintain visual detection at greater ranges. Ironically, the APFSDS projectiles, which are the most demanding on tracer diameter requirements, are the most difficult designs to incorporate an adequately large diameter tracer in small caliber systems, since they are based on flying a long but slender rod penetrator to a more distant target.

Tracer cavity diameter, based on tracer light intensity, scales proportional to the range of the projectile squared. For adequate trace detection up to an effective range of 3500 meters, a tracer cavity diameter of approximately 16 millimeters is required. This is typical of large caliber tank gun projectiles, such as for the 120 millimeter cannon. In a 120 millimeter diameter projectile, the tracer cavity diameter represents approximately 17% of the gun bore diameter. Tracer diameters of 8 millimeters are sufficient for an effective range of 2500 meters, and are typically found in projectiles for guns of 30 millimeter diameter. In a 30 millimeter projectile, the tracer cavity represents approximately 26% of the gun bore diameter. In small caliber gun systems, for example the 12.7 millimeter (0.50 inch) caliber heavy machinegun, a minimum tracer cavity diameter of approximately 5 millimeters is required for adequate trace to a maximum effective range of 2000 meters. This small caliber tracer diameter requirement represents nearly 40% of the small caliber gun bore diameter. One sees that when scaling projectile designs down from large caliber to small caliber, the requirements for tracer cavity diameter scales up significantly, from 13% of bore diameter to nearly 40% of bore diameter. Therefore, existing large caliber APFSDS projectile designs are inappropriate for use in small caliber systems.

Clearly, APFSDS projectiles, which include a tracer cavity in the rod penetrator, exist for gun systems with bore diameters greater than or equal to 30 millimeters. It is equally true that the proportions of the tracer cavity in these large projectiles is adequate for these gun systems. However, it is erroneous to conclude on the basis of these large caliber designs that an adequate tracer cavity can be easily incorporated into an APFSDS projectile for gun systems of caliber less than 25 millimeters, where the tracer cavity requirements are double the proportions required in the larger caliber projectiles. Incorporating an adequate tracer cavity in a small caliber APFSDS projectile requires significant design tradeoffs not required in larger caliber projectile systems, and the use of design methodologies heretofore unpracticed.

Therefore, prior APFSDS projectile designs which offer greater armor penetration were inappropriate for small caliber guns where a tracer cavity is required, and prior APDS projectile designs did not allow for an effective armor penetrator with a tracer cavity. Prior small caliber APDS projectile designs are also faulty in that the sabot discard process introduces trajectory inaccuracies for the rod projectile. Prior larger caliber APFSDS projectile designs, however, have demonstrated that proper sabot and obturator design can provide trajectory accuracies comparable with those of full-bore projectiles.

Accordingly, it is advantageous to provide an armor piercing fin stabilized discarding sabot (APFSDS) projectile for small caliber guns which minimizes sabot parasitic weight and structural complexity, facilitates rapid sabot separation upon muzzle exit without introducing trajectory inaccuracies for the rod projectile, maximizes armor penetrator weight and length, and provides for an adequate tracer cavity in the rear of the flight projectile.

SUMMARY

Accordingly, several objects and advantages of my invention are to provide a small caliber Armor Piercing Fin Stabilized Discarding Sabot Tracer (APFSDS-T) projectile which overcomes the problems set forth in detail herein above.

The projectile assembly of this invention is made up of a subcaliber high density rod penetrator of length substantially longer than its external diameter, with an internal tracer cavity in the based portion, an external threaded or grooved region along the central portion of its long axis, and aerodynamic contouring of the forward nose portion; a stabilizing fin appendage of substantially full-bore diameter with a through-hole along its central axis to provide for continuation of the tracer cavity and for affixing to the aft portion of the rod penetrator; a segmented structural sabot of low density metallic material with an internal threaded or grooved cavity along its symmetric axis for attachment to the rod penetrator; the sabot is of length less than or equal to its external diameter, with a central bulkhead region of substantially full-bore diameter which engraves into the barrel rifling, a tapered concave ramp aft of the bulkhead, and a substantially equal length tapered concave ramp forward of the bulkhead; behind the sabot is a segmented low density plastic obturator of substantially full-bore diameter which engraves into the barrel rifling and has a forward tapered surface for mating with the tapered aft ramp of the sabot with an interference fit, a through-hole along its central axis with internal diameter slightly less than the external diameter of the rod penetrator for an interference fit, and an aft ramp that tapers down from full-bore diameter to a cylindrical section; followed by a solid lightweight plastic obturator ring of substantially full-bore diameter which engraves into the barrel rifling and has a forward internal cavity which mates with the aft ramp of the segmented obturator with an interference fit, a central internal bulkhead of internal diameter slightly less than the external diameter of the rod penetrator for an interference fit, and to ensure an uninterrupted gas seal at the base of the segmented components. This solid obturator ring has an aft opening internal cavity for trapping propellant gases during firing.

Unlike the present series of Armor Piercing Discarding Sabot (APDS) projectiles, the penetrating rod of this invention extends through the rear of the structural sabot and obturation components. This is to accommodate the requirement for stabilizing fins at the rear of the rod penetrator, and an internal tracer cavity, which must be exposed to the hot propellant gases during projection down the barrel to ignite the tracer pyrotechnic composition. Unlike the present series of small caliber APDS projectiles, the rod penetrator of this invention incorporates a tracer cavity without degradation of its armor penetrating mass and length. The present series of small caliber APDS projectiles require a ballistically matched tracer projectile to provide the visual signal of the projectile trajectory to the gunner. This tracer projectile is of poor ballistic match to the penetrating projectile, which cannot provide its own visual signal. This invention provides the visual signal as well as the armor penetration in one projectile.

The present series of larger caliber APDS projectiles provide for the tracer cavity in the rear of the spin stabilized rod penetrator without significant degradation of the rod's armor penetration. However, spin stabilization of rod projectiles does not scale down in proportion to the geometric scaling of the projectile form. Therefore, these larger caliber rod designs, if scaled down, will not fly with stability when launched from small caliber guns.

Tracer cavity requirements also do not scale down, since a minimum tracer cavity diameter and depth is required for visual detection by the eye over the total time of the trajectory. Therefore, the tracer cavity diameter and length in small caliber systems must be substantially greater in proportion to the rod penetrator's diameter and length than it has to be in larger caliber systems. As a result, small caliber APDS projectiles of present series designs cannot incorporate both a tracer cavity and increased armor penetration over full-bore small caliber projectiles. This invention is the method of incorporating both a tracer cavity and an armor penetrating rod into a single small caliber discarding sabot projectile.

The present series of Armor Piercing Fin Stabilized Discarding Sabot Tracer (APFSDS-T) projectiles are of inappropriate design for scaling to a small caliber projectile. In larger caliber APFSDS-T projectile design, the object is to maximize the penetrating rod length and minimize its diameter so that armor penetration potential is maximized. The major limiting factors on how long and how thin the penetrating rod can be made in large caliber projectiles are the overall length of the cartridge case, the strength of the penetrating rod material, the strength of the structural sabot, and the maximum acceleration that the projectile will undergo during launch. As a result, in larger caliber projectile designs, the fin stabilized penetrating rod is of external diameter substantially less than one third the full bore diameter of the barrel. Under these circumstances the length of the penetrating rod can be substantially greater than fifteen times the diameter of the rod, and the diameter of the rod is still sufficient to accommodate an adequate tracer cavity. With very long rod designs, the structural sabot must be sufficiently long to support the rod during launch. For this reason, larger caliber sabots weigh substantially more than one third the weight of the penetrating rod. The present series of larger caliber APFSDS-T projectile designs are inappropriate for small caliber guns because the larger caliber designs can readily accommodate a tracer cavity in the penetrating rod due to the larger rod diameter; the rods are substantially longer in proportion to their diameter than those that can be launched with high velocity from small caliber guns; and the sabot designs of larger caliber projectiles are too heavy in proportion to the weight of the rod penetrator to provide for sufficient armor penetrating rod material in small caliber projectiles.

Unlike the present series of APFSDS-T projectiles, this invention provides for an adequately large tracer cavity in a small caliber APFSDS-T projectile with greater armor penetration performance than present small caliber APDS projectiles. This results in a fin stabilized penetrating rod of diameter substantially greater than one third the full-bore diameter, and a penetrating rod length of substantially less than fifteen times the rod diameter. For greater mass-energy efficiency in the projectile, the weight of the structural sabot is substantially less than one third the weight of the penetrating rod. This invention, therefore, provides for greater armor penetration with an integral tracer in the penetrating rod in a small caliber projectile by applying design practices which are counter to the design practices which make the present series of APFSDS-T projectiles greater armor penetrating projectiles in larger caliber guns.

To facilitate sabot separation without introducing trajectory inaccuracies for the rod projectile, the structural sabot is segmented longitudinally into equal parts of either two, three, or four identical components. This is like the present series of APFSDS-T projectiles. Unlike the present series of APFSDS-T projectiles, this invention does not require an air scoop attached to the forward sabot ramp to facilitate fracture of the solid plastic obturator and sabot separation upon exiting the barrel muzzle and entering the free air stream. In this invention, the small caliber rifle barrel imparts spin to the projectile as it is launched which provides sufficient forces for the sabot segments to separate upon release from the confines of the barrel. In addition, entrapped muzzle gas pressure facilitates fracture of the solid plastic obturator in this invention. The elimination of the sabot scoop provides additional weight savings in the sabot design in this invention.

In the present series of APFSDS projectiles, the axial distance between the forward sabot air scoop and the aft sabot bulkhead provides the required bore-riding length for projectile stability as it travels down the barrel during launch. Unlike the present series of APFSDS projectiles, this invention provides for the required bore-riding length with a sufficiently long plastic obturator mating to the aft ramp of the structural sabot. To facilitate obturator separation without introducing trajectory inaccuracies for the rod projectile, the forward component of the obturator is segmented longitudinally into equal parts of either two or three identical components. Unlike in larger caliber guns, small caliber rifle barrels impart insufficient spin to cause this mass of obturator material to fracture upon release from the barrel muzzle. For this reason it is segmented in this invention. To retain the segmented portions of the sabot and forward component of the obturator prior to launch, the aft portion of the obturator is a solid plastic ring which mates over the aft portion of the segmented obturator components. This obturator ring has an aft cavity which retains propellant gas pressure and expands radially to seal against the barrel wall during launch. Upon muzzle exit, the entrapped gas pressure is sufficient to fracture this obturating ring permitting it to separate freely from the rod projectile.

The present series of APDS projectiles utilizing plastic obturator components employ faulty design practices which are not found in this invention. Unlike the present series of APDS projectiles, this invention places the plastic obturating materials aft of the structural sabot where they are subjected to the high propellant gas pressures during travel down the barrel. In this configuration, the plastic materials behave as a fluid would behave under hydrostatic pressure. Under hydrostatic pressure, the plastic material can fail structurally, but a crack cannot propagate since the three orthogonal components of the state of stress are equal and under compression. For this reason, in this invention, this obturator component can be completely segmented without compromising structural integrity or in-bore stability during launch. Upon muzzle exit, this forward obturator component then falls freely away since the barrel is no longer present to retain it. The solid ring obturator component in this invention retains pressurized propellant gases within its aft cavity until muzzle exit, where it will fracture and fall freely away without the presence of the barrel to restrict its radial motion.

Both a segmented obturator and a solid ring obturator are required for the proper functioning of this invention. Entrapped muzzle gas pressure is insufficient to fracture the combined lengths of plastic of the segmented obturator and solid ring obturator if they were integral and non-segmented. In addition, in a small caliber gun, the spin rate inertial force is insufficient to fracture the combined lengths of plastic of the segmented obturator and solid ring obturator if they were integral and non-segmented. Therefore, the unique gun characteristic of muzzle gas pressure is utilized to fracture an optimum length of solid plastic obturator material, which is used in this projectile only to retain the segmented components prior to launch. The remaining plastic obturator material, required for in-bore stability of the projectile is pre-segmented so that it falls freely away upon muzzle exit. This is a unique characteristic of this invention, which eliminates the requirement to utilize spin rate inertial force to separate obturator components, as used in the present series of APDS and projectiles.

The present series of APDS projectiles utilize faulty design practices in their plastic obturation components by placing substantial lengths of plastic forward of the propellant gas pressure obturation surface, where gas pressure cannot act to separate the plastic from the rod penetrator once free of the barrel. The present series of APDS projectiles do not provide for an aft cavity in the plastic obturation components so that pressurization cannot assist in plastic separation once free of the barrel. To facilitate separation of the forward plastic obturation components in the present series of APDS projectiles, several longitudinal grooves are cut into the plastic material on either the outside or inside surface to provide fracture points. Once free of the muzzle, the plastic material fractures due to the rotational spin on the projectile and the components open to catch the free air stream and are then forced completely off of the rod projectile. This technique of grooving the forward plastic obturation components in the present series of APDS projectiles is a faulty design practice, since it requires that the plastic components not fracture in the barrel due the inertial force of the spin rate, yet must somehow fracture outside the barrel due to the same spin induced inertial force.

Since spin rate and its inertial force is a maximum at the barrel muzzle and cannot increase once the projectile is free from the barrel, the plastic components must fracture at some point prior to or precisely at the muzzle, or they will not separate upon barrel exit. It is impossible to design the fracture points to fail consistently and exactly at the muzzle, which is the intent in the present series of APDS projectiles. If the fracture points are too strong, the plastic components will not separate upon muzzle exit. Therefore, they must be designed to fracture at some point prior to muzzle exit. Since these forward plastic components are not held in place under hydrostatic pressure conditions, they are free to move around the rod projectile when they fracture in the barrel prior to muzzle exit. This premature fracture condition introduces in-bore instabilities for the rod projectile which translate into trajectory inaccuracies once the projectile is free of the barrel. It is for this reason that the present series of APDS projectiles have been reported to have sabot discard problems, which introduce trajectory inaccuracies for the rod projectile.

Unlike the present series of APDS projectiles, this invention places plastic obturator components behind the structural sabot where they can be completely segmented and yet hold together during launch by the hydrostatic propellant gas pressure and then be blown off by the same gas pressure once free of the barrel muzzle, thus avoiding trajectory disturbances for the rod projectile. Placing segmented plastic obturator components aft of the structural sabot in small caliber APFSDS projectiles has heretofore never been undertaken and successfully achieved.

It is an object of this invention to provide a small caliber armor piercing projectile which incorporates therein a sub-caliber high density rod penetrator with suitable aerodynamic stabilization and a tracer cavity.

It is still another objective of this invention to provide an armor piercing projectile which incorporates a lightweight segmented structural sabot of length equal to or less than its bore-riding diameter, having a central bulkhead which engages the barrel rifling, a forward and an aft tapered ramp of nearly equal length, and a groove or threaded mechanical interface to support the high density sub-caliber rod penetrator during handling and launch.

It is still another objective of this invention to provide an armor piercing projectile which incorporates a lightweight segmented obturator which engages the barrel rifling and is located aft of the structural sabot.

It is still another objective of this invention to provide an armor piercing projectile which incorporates a lightweight solid obturator ring which engages the barrel rifling and provides a solid internal bulkhead for complete gas sealing behind the segmented components, and retains the segmented obturator and sabot components assembled around the penetrator during handling and launch, and is then fractured and discarded from the assembly at muzzle exit due to entrapped propellant gas pressure retained in an open ended aft cavity.

These and other objects of the invention will be better understood by reference to the following detailed descriptions, accompanying drawings, and claims.

BRIEF DESCRIPTION OF THE DRAWINGS

The specification concludes with a claim particularly pointing out and distinctly claiming the subject matter of the present invention. However, it is believed that the invention will be better understood from the following description taken in connection with the accompanying drawings in which:

DESCRIPTION OF THE PREFERRED EMBODIMENTS

Figure 1:
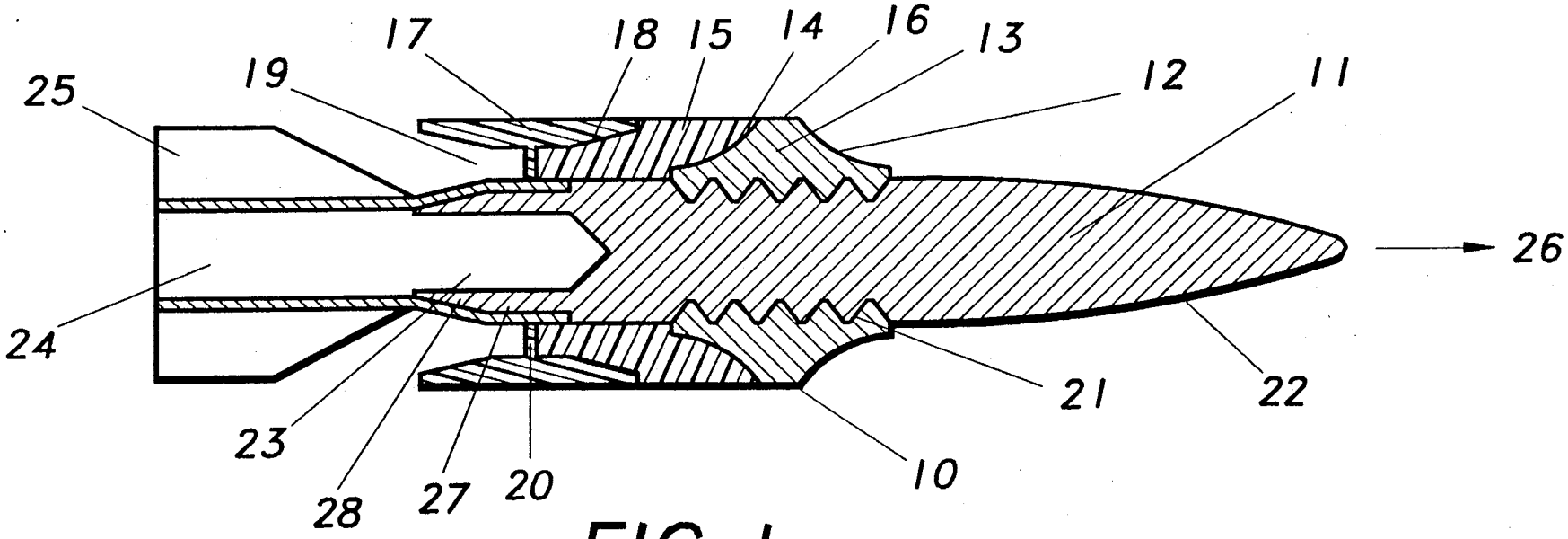
FIG. 1 is a cross-sectional view of one embodiment of the invention.

FIG. 1 shows a cross-sectional view of my invention, an armor piercing fin stabilized discarding sabot tracer (APFSDS-T) projectile 10, providing an advantage not heretofore obtained in small caliber gun systems with the present series of discarding sabot projectiles. The major components or parts of this new projectile include an elongated rod penetrator core 11, made of high density material such as tungsten alloy or depleted uranium alloy. With respect to travel direction 26, attached to the rear portion of the penetrator core with a suitable interference fit is a stabilizing fin appendage 25. The interference fit is provided by conical boattail section 28 and a lesser diameter cylindrical section 27 at the rear of the rod penetrator. The boattail section at the rear of the rod penetrator allows for reduced aerodynamic base drag. Sub-caliber flight projectile 22 is the assembly of the rod penetrator and the stabilizing fins. The stabilizing fins are made of high strength aluminum or steel. In the base portion of the rod penetrator is machined a tracer cavity 23, which is filled with a suitable pyrotechnic composition. The fin appendage contains a through-hole 24 for continuation of the tracer cavity. Attached to the outside of the penetrator core with a threaded or grooved interface 21 is a segmented structural sabot 13. The segmented sabot is made from strong, low density material such as aluminum or magnesium alloy, and is segmented longitudinally into a plurality of equal parts. The segmented sabot has a central bulkhead region 16 of diameter sufficient to permit it to engage the barrel rifling, flanked by a concave aft sabot ramp 14 and a concave front sabot ramp 12. These ramps are concave in form to give the sabot the lowest weight and highest strength combination for the launch mass and acceleration of the rod penetrator. The concave aft ramp also provides a strong interlocking surface with aft obturator components. The aft sabot ramp is of substantially equal length to the front sabot ramp so that the total sabot weight is minimized. Located behind the sabot is a segmented obturator 15. The segmented obturator is made from low density plastic material such as nylon, and is segmented longitudinally into a plurality of equal parts. The external diameter of segmented obturator 15 is sufficient to permit it to engage the barrel rifling. The forward convex surface of the segmented obturator mates with the concave aft sabot ramp with a tight interference fit. The aft portion of the segmented obturator has a tapered ramp 18 with a tight interference fit assembly into a solid obturator ring 17. The solid obturator ring is not segmented and with solid internal bulkhead 20 forms a continuous gas seal around the projectile base from the bore to the rod penetrator. The solid internal bulkhead fits tightly over the rod penetrator surface and the front internal cavity of the solid obturator ring fits tightly over tapered ramp 18 so that the rod penetrator, the segmented sabot, and the segmented obturator are held tightly in place prior to cartridge ignition. The solid obturator is made from low density plastic material such as nylon, and has an external diameter sufficient to permit it to engage the barrel rifling. An aft cavity 19 is provided opening to the rear in the solid obturator ring to lighten its weight and to entrap propellant gas pressure during down-bore travel to seal the barrel during launch and to fracture the plastic when free of the barrel muzzle. Sufficient in-bore stability for the projectile during launch is provided by the combined bore-riding lengths of the solid obturator, the segmented obturator and the segmented sabot. The external diameters of the solid obturator, segmented obturator, and segmented sabot are sufficiently full-bore to permit each to engage the barrel rifling to provide tight in-bore assembly of the projectile.

Figure 2:
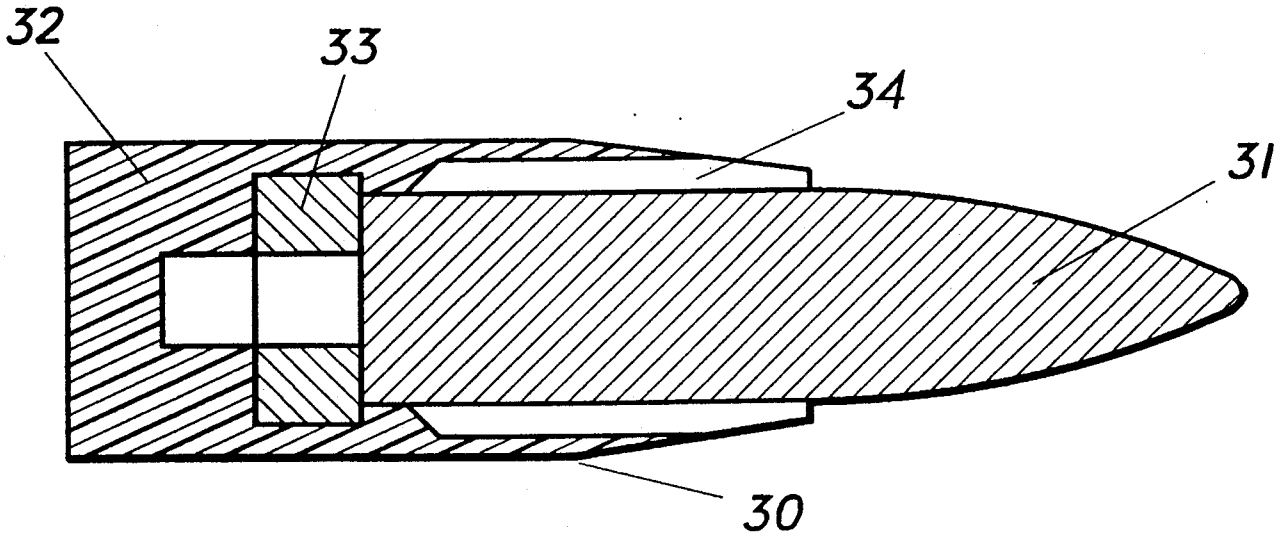
FIG. 2 PRIOR ART
FIG. 2 is a cross-sectional view of a current Armor Piercing Discarding Sabot (APDS) Projectile as used in small caliber gun systems like the 12.7 millimeter (0.50 inch) caliber heavy machinegun.

FIG. 2 shows a cross-sectional view of an existing 12.7 millimeter (0.50 inch) caliber armor piercing projectile 30 which does not provide the advantages heretofore obtained with my invention. The projectile in FIG. 2 is a spin stabilized armor piercing discarding sabot (APDS) projectile which contains a sub-caliber rod penetrator 31, but no tracer cavity. The rod penetrator is encapsulated in a solid plastic obturator 32 and supported from the rear by an aluminum alloy pusher plate 33 also known as an area multiplier. Longitudinal grooves 34 are cut into the internal side wall of the solid obturator as predetermined fracture points to facilitate obturator discard upon muzzle exit. Some APDS projectiles have longitudinal grooves cut into the external side wall of the solid obturator. The intent in these designs is provide similar predetermined fracture points in the plastic. Solid obturator 32 in projectile 30 has an external diameter sufficient to permit it to engage the barrel rifling and impart spin to the entire projectile assembly.

Figure 3:
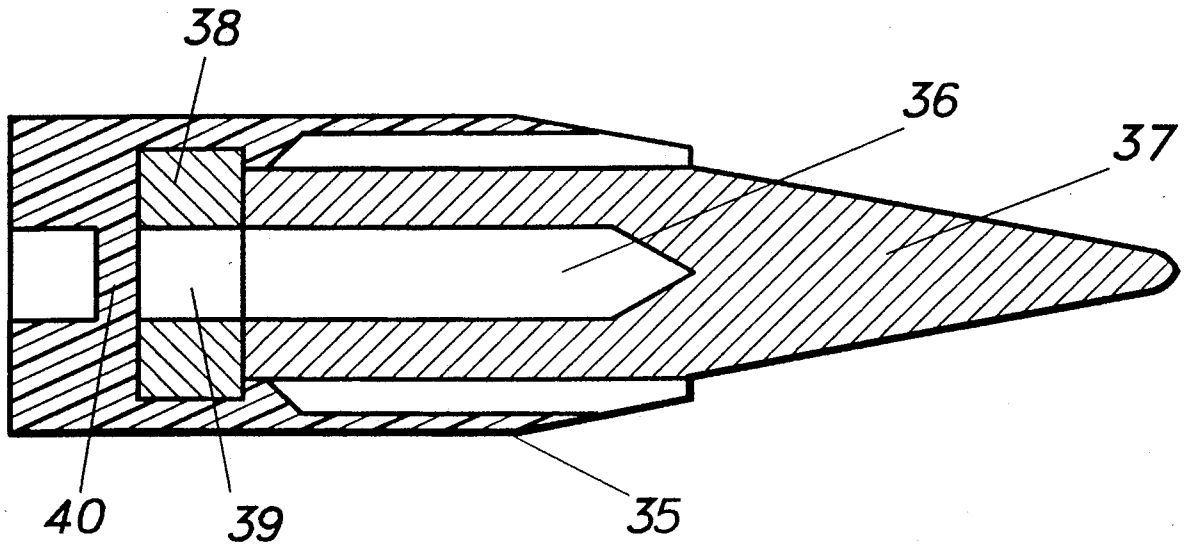
FIG. 3 PRIOR ART
FIG. 3 is a cross-sectional view of a current Armor Piercing Discarding Sabot (APDS) Projectile which incorporates a tracer cavity as used in small caliber gun systems like the 12.7 millimeter caliber heavy machinegun.

FIG. 3 shows a cross-sectional view of an existing 12.7 millimeter caliber armor piercing projectile 35 which does not provide the advantages heretofore obtained with my invention. The projectile in FIG. 3 is intended to be the ballistically matched tracer projectile for the projectile in FIG. 2. For this reason the rod penetrator in FIG. 3 has internal tracer cavity 36. To accommodate tracer cavity 36 in projectile 35, considerable material is removed from rod penetrator 37, which degrades its armor penetration. To permit ignition of the tracer pyrotechnic material, pusher plate 38 has a through-hole 39. To ignite the tracer composition, solid barrier 40 in the obturator is perforated by the hot propellant gases prior to muzzle exit.

Figure 4:
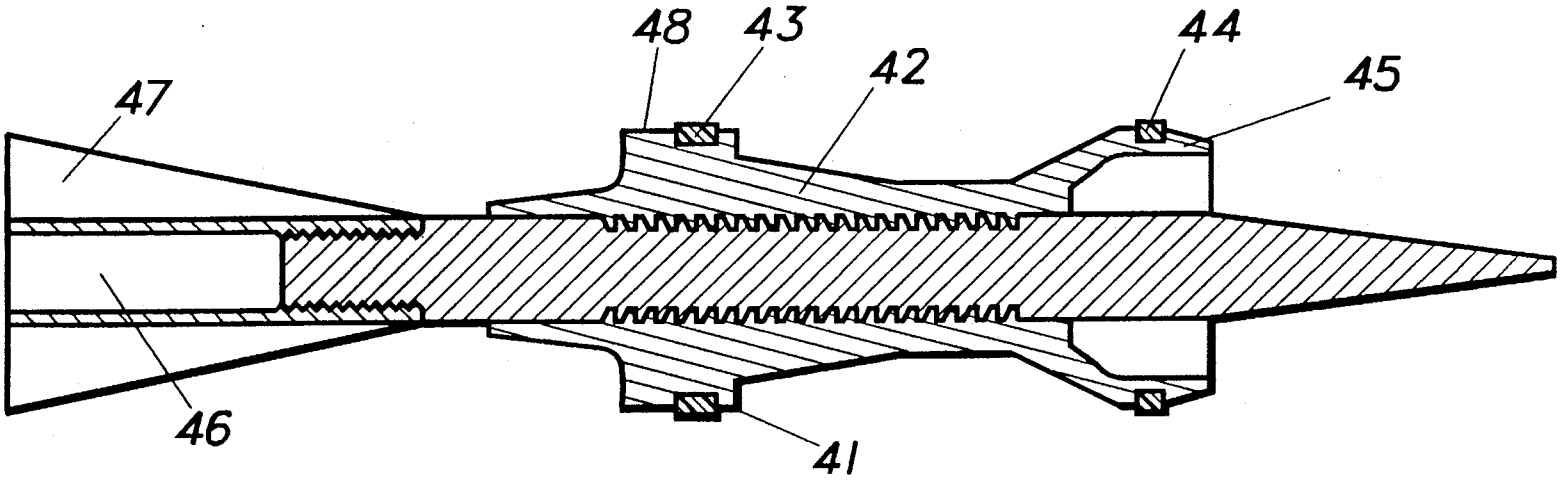
FIG. 4 PRIOR ART
FIG. 4 is a cross-sectional view of a current Armor Piercing Fin Stabilized Discarding Sabot (APFSDS) Projectile which incorporates a tracer cavity as used in large caliber gun systems like the 30 millimeter caliber automatic cannon.

FIG. 4 shows a cross-sectional view of an existing 30 millimeter caliber armor piercing projectile 41 which does not provide in small caliber the advantages heretofore obtained with my invention. Segmented sabot 42 for projectile 41 is retained prior to launch by solid aft obturator 43 and forward solid obturator 44. Sabot 42 in projectile 41 is bore-riding in that the sabot material does not engage the barrel rifling, but rides on the top of the rifling lands. In this projectile, the solid obturators engage the barrel rifling and hold the sabot back against the spin induced inertial force. For some projectiles of this design, spin-decoupling obturators are required so that the spin induced inertial force will not be completely transmitted to the sabot and cause it to expand and press into the rifling despite the presence of the obturator material. Having the sabot engage the rifling in these designs results in catastrophic in-bore failure of the sabot. To prevent this from happening, some designs have had to attach steel shields over the sabot bore-riding surfaces. These sabot complexities are not required in my invention.

Sabot 42 in projectile 41 is too long in proportion to its bore-riding diameter to be weight efficient in small caliber projectiles. Sabot air scoop 45 is also required to force the sabot to separate from the rod penetrator once free of the barrel muzzle. Sabot air scoop 45 is also required in this projectile to provide adequate in-bore stability. The sabot air scoop is not weight efficient in small caliber projectiles and unnecessary in my invention for proper sabot discard upon muzzle exit. Projectile 41 in FIG. 4 provides for tracer cavity 46 inside stabilizing fins 47, and is of adequate diameter and depth in 30 millimeter projectiles, but is of insufficient diameter and depth if scaled down to small caliber projectiles. My invention contains the necessary improvements to make an APFSDS-T projectile fully functional and a greater armor penetrator in small caliber guns.

OPERATION OF THE INVENTION

When the invention, projectile 10 as shown in FIG. 1, is fired in a gun, the expanding propellant gases exert a positive force on the projectile base. The material mass per base area of rod penetrator 11 is greater than the combined material mass per area of solid obturator 17 plus segmented obturator 15 plus segmented sabot 13. This mass per area imbalance results in a positive traction force in interface 21 between the rod penetrator and the sabot. The material strengths and groove form are chosen such that the interface will not fail in shear and allow the sabot and penetrator to move relative to each other in the longitudinal direction. This results in the sabot and the rod penetrator traveling down-bore as an assembled unit. The gun barrel prevents the sabot segments from moving radially outward away from the rod penetrator during down-bore travel. The gas pressure which forces the projectile down-bore forces solid obturator 17 forward against segmented obturator 15 which in turn is forced forward against sabot 13, as all components travel down-bore. As the projectile begins its down-bore travel, sabot bulkhead 16 engages the barrel rifling developing a radially compressive force keeping it in tight contact with rod penetrator 11. Similarly, segmented obturator 15 and solid obturator 17 engage the barrel rifling developing a radially compressive force keeping them in tight contact with each other, the sabot, and the rod penetrator. As these obturator components are forced forward, concave aft sabot ramp 14 forces segmented obturator 15 to ride radially outward ensuring positive radial pressure against the barrel wall thus providing a tight assembly against the sabot and penetrator and a seal against the propellant gas pressure. Solid obturator 17 is similarly forced radially outward by the trapped gas pressure in pressurized cavity 19 thus ensuring a tight seal against the propellant gas pressure, and solid bulkhead 20 pushes forward against the base of the segmented obturator preventing any gas leaking forward through the segmented components.

When the projectile exits the barrel muzzle, the trapped gas pressure in cavity 19 causes solid obturator 17 to fracture radially outward away from rod penetrator 11, since the gun barrel is no longer present to restrict radial movement. The other obturator and sabot components are already segmented so no additional breaking of materials is required, and the tangential spin velocities result in segmented obturator 15 and segmented sabot 13 flying free of rod penetrator 11. The fin stabilized sub-caliber rod penetrator is not free to fly undisturbed towards its target.

The operation of my invention is significantly different from the operation of projectile 30 in FIG. 2 and projectile 35 in FIG. 3. In these projectiles only solid plastic obturator 32 is employed for in-bore stability and gas pressure sealing, and there is no provision for muzzle gas pressure to aid in obturator separation. To facilitate obturator separation, concave longitudinal grooves 34 are cut into the forward portion of the obturator. There are four grooves cut at even spacing around the circumference of the obturator to the approximate length and depth shown in FIGS. 2 and 3. The idea with these grooves is to create fracture points so that the forward portion of the obturator will peel backwards against the air pressure upon muzzle exit. The tangential spin velocity of the projectile is intended to give initial motion to peel back the fractured obturator material adjacent to grooves 34. Once this obturator material is fully extended radially, the air pressure will cause the entire solid obturator to slide backwards and release the rod penetrator.

This type of obturator separation is a faulty design practice and is significantly different from obturator separation in may invention. The solid obturator of the projectiles in FIGS. 2 and 3 relies solely on the inertial force derived from projectile spin rate as the mechanism for beginning obturator separation. Once separation begins upon muzzle exit due to the inertial force, the free stream air pressure finishes the separation process. However, the inertial force which begins the separation process at muzzle exit is the same inertial force that must cause the pre-cut fracture points to fail prior to muzzle exit, if the obturator is to separate at all from the rod projectile. Spin rate, and therefore, its inertial force is a maximum at the barrel muzzle. For this solid obturator to provide adequate in-bore stability and structural support so that trajectory inaccuracies are not imparted to the rod projectile, the obturator cannot fracture prior to muzzle exit. In these projectiles the obturator must fracture prior to muzzle exit if it is to separate at all from the rod projectile. This is how trajectory inaccuracies are introduced in prior APDS projectiles.

In my invention, projectile 10 in FIG. 1, the obturator is presegmented so that spin induced inertial force is not required to fracture it and start its separation process after muzzle exit. Solid obturator 17 retaining segmented obturator 15 prior to launch is fractured at muzzle exit due to pressurized gases in obturator cavity 19. All of these plastic components which must discard from the projectile are located behind the sabot so that they are maintained under hydrostatic pressure and cannot move from their intended positions during launch. In this manner, in-bore stability is provided to the rod penetrator so that trajectory inaccuracies do not occur.

The operation of my invention is significantly different from the operation of projectile 41 in FIG. 4. Projectile 41 in FIG. 4 derives in-bore stability from the longitudinal distance separating the bore-riding surfaces of sabot bulkhead 48 and sabot air scoop 45. This design approach is inappropriate for a small caliber projectile because the use of the long sabot in FIG. 4 results in excessive weight penalty in a small caliber projectile design. My invention derives in-bore stability from the long bore-riding surfaces of the solid obturator, the segmented obturator, and the bulkhead region of the sabot. The sabot of projectile 41 in FIG. 4 and in similar designs does not engage the barrel rifling which is a disadvantage in maintaining tight projectile assembly during in-bore travel. The sabot in my invention engages the barrel rifling to impart spin to the projectile which assists in sabot discard and to ensure tight assembly during launch.

The sabot separation process for my invention is significantly different from the sabot separation process for projectile 41 in FIG. 4. Sabot 42 of projectile 41 requires the use of air scoop 45 to force open the sabot segments upon muzzle exit. These sabot segments are retained prior to launch by aft solid obturator 43 and forward solid obturator 44. In large caliber guns, the force of the air pressure within the air scoop is sufficient to break these plastic obturators so that the sabot segments can fly freely away from the rod projectile without introducing trajectory inaccuracies. My invention in FIG. 1 utilizes trapped muzzle gas pressures within obturator cavity 19 to fracture solid obturator 17 so that segmented obturator 15 and segmented sabot 13 can fly freely away from the flight projectile without introducing trajectory inaccuracies.

CONCLUSIONS, RAMIFICATIONS, AND SCOPE OF INVENTION

This reader will see that the projectile of the invention provides an improved, highly efficient, low mass-energy loss discarding sabot of high in-bore stability and high trajectory accuracy, for a superior sub-caliber armor penetrating rod with an adequate tracer cavity, for small caliber gun systems.

It is intended that my invention be utilized in a wide range of small caliber guns of bore diameter less than or equal to 25 millimeters, for which it is a more efficient armor piercing projectile design. While my above description contains many specificities, these should not be construed as limitations on the scope of the invention, but rather as an exemplification of one preferred embodiment thereof. For example, the threaded or grooved interface between the sabot and the rod penetrator can have more or less grooves or threads of different pitch, depth and form. The sabot can be segmented longitudinally into two, three, or more equal parts. The sabot material can be aluminum alloy or lower density magnesium alloy depending on the gun system use. The penetrator may be of steel, tungsten alloy or depleted uranium alloy depending on the gun system and the target under consideration. The obturator can be segmented longitudinally into two, three or more parts. The segmented obturator surfaces can be flat or contain an interlocking mechanism, such as a tongue-in-groove interface between adjacent segments. The segmented obturator can be of different length depending on the projectile caliber, and the aft tapered contour can be of different form depending on how it best locks with the solid obturator component. The solid obturator can have more or less of a pressurized obturator cavity depending on the barrel pressures of the gun system under consideration. The fin stabilization can be exchanged with a cone stabilizer depending on the launch velocity of the gun system under consideration. A cone or flare stabilizer is a conical tapered appendage which provides unique stability characteristics depending on flight Mach number. The nose of the penetrator rod can have a different aerodynamic contour, from tangent ogive to straight cone, depending on the desired aerodynamics of the flight projectile. Other streamlining aspects of the rod penetrator can also be modified as required by the gun system application.

Efficient armor piercing projectile design involves a careful balance of many gun and armor target parameters, which are unique to each system under consideration. Nevertheless, certain critical design practices apply across the boundaries of small caliber gun systems. These practices include the need to incorporate a tracer cavity of adequate diameter and depth for the eye to track the trajectory of the sub-caliber projectile; the tracer cavity cannot detract from the armor penetrating potential of the rod penetrator; the segmented sabot weight is minimized for its in-bore stability and structural requirements; and the projectile obturation provides adequate propellant gas sealing and still separates cleanly from the rod projectile once free from the barrel without introducing trajectory inaccuracies.

To accomplish these requirements in small caliber projectiles, the rod penetrator is made longer to accommodate the tracer cavity so that removal of high density or high strength armor penetrating material is unnecessary. Making the rod longer to accommodate the tracer cavity requires that the rod penetrator be fin stabilized. Minimizing the segmented structural sabot weight requires a sabot design which is of length less than its bulkhead diameter, and has forward and aft sabot ramps which are concave and of substantially equal length. Clean separation of the projectile obturator upon muzzle exit requires that the obturator components be themselves segmented, but placed aft of the structural sabot so that the propellant gas pressures will maintain the obturator segments under hydrostatic compression while in the barrel to ensure projectile in-bore stability. The invention is the embodiment of these design practices for armor piercing projectiles for use in small caliber gun systems.

I claim:

1. A discarding sabot projectile comprising:

a sub-caliber rod penetrator having an outer surface, having a central cylindrical region; said central cylindrical region having a grooved interface;

a sabot disposed circumferentially about said central cylindrical region; said sabot having a sabot concave aft ramp; said sabot is segmented longitudinally into a plurality of parts; and a plastic obturator assembly comprising; a segmented plastic obturator having an internal surface mating with said outer surface of said sub-caliber rod penetrator and having a forward internal convex surface mating with said sabot concave aft ramp and having a tapered aft ramp; a solid plastic obturator ring having an internal bulkhead mating with the outer surface of said sub-caliber rod penetrator; said internal bulkhead providing an uninterrupted gas seal to prevent leakage of propellant gasses forward into the segmented obturator; said solid obturator ring having a forward internal cavity in front of said internal bulkhead which mates with said tapered aft ramp of said segmented obturator and having an internal aft cavity behind said internal bulkhead; said internal aft cavity formed by an inner surface of said solid obturator ring and said outer surface of said sub-caliber rod penetrator; said internal aft cavity serving to entrap propellant gas pressure to facilitate fracture of the solid obturator ring upon muzzle exit.

2. The discarding sabot projectile as defined in claim 1 wherein said sub-caliber rod penetrator is made from material selected from the group consisting of tungsten alloys, depleted uranium alloys, and steels.

3. The discarding sabot projectile as defined in claim 1 wherein said sabot is made from material selected from the group consisting of aluminum alloys and magnesium alloys.

4. The discarding sabot projectile as defined in claim 1 wherein said segmented plastic obturator and said solid plastic obturator ring are made from nylon material.

5. The discarding sabot projectile as defined in claim 1 wherein said sub-caliber rod penetrator has a rearward opening tracer cavity; said sub-caliber rod penetrator further including a means for aerodynamic stabilization located at the aft end of said sub-caliber rod penetrator; said means for aerodynamic stabilization having a through-hole providing increased tracer cavity depth.

6. The discarding sabot projectile as defined in claim 5 wherein said means for aerodynamic stabilization is made from material selected from the group consisting of aluminum alloys and steels.

* * * * *